US005148644A

United States Patent [19]

Weir

[11] Patent Number: 5,148,644

[45] Date of Patent: Sep. 22, 1992

[54] PROTECTIVE COVERING STRIP

[76] Inventor: Randy S. Weir, P.O. Box 247, Kapaa, Kauai, Hi. 96746

[21] Appl. No.: 591,776

[22] Filed: Oct. 2, 1990

[51] Int. Cl.[5] ..... E04D 13/00

[52] U.S. Cl. ..... 52/300; 52/97; 52/301; 52/58; 52/105

[58] Field of Search ..... 52/97, 58, 101, 105, 52/169.5, 300, 301

[56] References Cited

U.S. PATENT DOCUMENTS

| | | | |
|---|---|---|---|
| 6,401 | 4/1875 | Winslow . | |
| D. 249,965 | 10/1978 | Cooper . | |
| D. 271,304 | 11/1983 | Kensrue . | |
| D. 283,444 | 4/1986 | Allard . | |
| 325,634 | 9/1885 | Smith . | |
| 889,240 | 6/1908 | Kanski . | |
| 1,996,400 | 4/1935 | Bowen | 52/301 |
| 2,862,255 | 12/1958 | Nelson . | |
| 2,991,857 | 7/1961 | Soderberg . | |
| 3,956,557 | 5/1976 | Hurst . | |
| 4,060,947 | 12/1977 | Naka . | |
| 4,126,977 | 11/1978 | Chisum . | |
| 4,356,676 | 11/1982 | Hauptman . | |
| 4,463,540 | 8/1984 | Gordon . | |
| 4,594,823 | 6/1986 | Hague . | |
| 4,620,403 | 11/1986 | Field . | |
| 4,742,654 | 5/1988 | Cole . | |
| 4,749,302 | 6/1988 | DeClute . | |
| 4,775,570 | 10/1988 | Ohlenforst et al. . | |
| 4,848,049 | 7/1989 | Hanson | 52/97 |
| 4,858,399 | 8/1989 | Salato, Jr. . | |

*Primary Examiner*—David A. Scherbel

*Assistant Examiner*—Wynn E. Wood

*Attorney, Agent, or Firm*—Banner, Birch, McKie & Beckett

[57] ABSTRACT

A protective covering strip is constructed of a flexible, waterproof material, such as rubber or a plastic compound, and is configured to fit over the upper and/or side surfaces of an elongated wooden member. The strip is formed as an inverted channel and has a length and width substantially corresponding to the length and width of the wooden member to ensure a snug fit. A plurality of longitudinal ribs are provided along the length of the strip. The side portions of the strip may be beveled outwardly to speed water runoff. In use, in the construction, for example, of a wooden deck, covering strips are secured to the top and/or side surfaces of the posts, joists and girders to separate and prevent any direct contact between the post/girder, girder/joist and joist/wooden flooring joints. The covering strips prevent the collection of water in the joints between the respective wooden members, and also prevent water seepage into nail holes formed during the assembly process. Intervening grooves disposed between the longitudinal ribs and longitudinal spacing or lateral scoring cooperate to facilitate water drainage and air circulation at the joints between the wooden members. This, in turn, prevents the growth of destructive fungus or woodrot which can lead to structural degradation. In another embodiment, the protective covering strip is a two-part member. The covering strip includes a layer of fungicide-saturated material disposed in the inverted channel.

18 Claims, 7 Drawing Sheets

PROTECTIVE COVERING STRIP

TECHNICAL FIELD

This invention relates to building construction materials generally, and more specifically to a protective covering strip for use in constructing wooden flooring, decking, and the like.

BACKGROUND OF THE INVENTION

In constructing wooden decks or other platform flooring, it is conventional to provide a plurality of spaced girders or horizontal beams, supported above the ground or building base by a plurality of vertical posts. A number of joists are arranged transversely along the length of the girders and are secured thereto so the joists extend longitudinally from one structural boundary to the other. Floor boards are then positioned transversely along the joists and are secured to the joists to complete the deck surface.

Typically, the girders are secured to the vertical posts using nails. The joists are also typically nailed to the girders, and the floor boards, in turn, are nailed to the joists. This "joinery" arrangement will usually provide sufficient structural support, but use of the arrangement can be disadvantageous in some situations, for example, in constructing open weather decks or other uncovered wooden flooring where the joists and girders will be exposed to water and moisture. In that situation, moisture and water may collect in the nail holes and in the joints between the posts and girders, in the joints between the joists and girders and in the joints between the joists and the deck members, keeping the joints wet and encouraging the growth of fungus or "woodrot".

SUMMARY OF THE INVENTION

It is an object of the present invention to provide a covering strip for preventing the rotting or molding of wooden members at intersecting joints, such as at the joints of posts and girders, at the joints of joists and girders, and at the joints of joists and planks of open weather decks, by protecting the structural elements from excessive moisture.

It is another object of the present invention to provide a covering strip which prevents the collection of water at the joints of wooden members and which also prevents water seepage into nail holes formed in securing the wooden members.

Yet another object of this invention is to provide a covering strip which can be easily manufactured without substantial costs.

A covering strip in accordance with the present invention is constructed of a flexible waterproof material, such as rubber or a plastic compound, and is configured to fit over an upper and/or side surface of an elongated wooden member as a waterproof cap. One embodiment of the strip includes an elongated body sized to substantially cover the entire upper surface of the wood member. The elongated body includes a main body portion and two side portions coextending with the main body and integrally connected to the main body on opposite sides thereof. The side portions cooperate to define a channel adjacent the undersurface of the main body, which extends longitudinally along the length of the strip between the side portions. An angled side rail projects outwardly from and runs substantially the entire length of each side portion. The strip is dimensioned so the distance between the side portions, i.e., the width of the channel, substantially corresponds to the width of the wooden member. When the strip is positioned onto the wooden member, a form-fitting relationship is obtained. A plurality of protrusions, more specifically longitudinal ribs or ridges, are located on the upper surface of the main body portion, and project above the surface of the strip to provide a base upon which the joists or floor boards are set and nailed. Lateral grooves through the protrusions separate the protrusions into longitudinally disposed groups.

In a second embodiment of the invention, the covering strip is similar to the first embodiment except the covering strip is a twopart member having a base member and at least one cover member.

Either embodiment may be used with a layer of fungicide saturated material, preferably felt, disposed in the channel to prevent the growth of destructive fungus on the wooden surface.

In use, in the construction, for example, of a wooden deck, covering strips are secured to the top surfaces of the posts, joists and girders. The girders are secured to the posts. The joists are then secured to the girders at the locations of the ridges, and the floor boards are, in turn, secured to the joists at the ridge locations. The covering strips, thus, separate the wooden members, and prevent any direct contact at the post/girder interface, at the girder/joist interface and at the joist/-wooden flooring interface. This arrangement has the advantage that it protects the joists from any direct contact with a wet surface such as the exposed wooden deck, while allowing the circulation of air around the protrusions at the post/girder, joist/girder and the joist/floor board interfaces. The lateral grooves also provide air circulation and drainage of water away from the wooden members of the deck.

The covering strips also provide a waterproof seal around the nails used to secure the strips at the post-/girder connection, at the joist/girder connection and at the floor board/joist connection, which prevents water seepage into the nail holes formed during the assembly process. The side rails of the strips are angled outwardly so that they extend away from the wooden member when the strip is in use to facilitate water run-off away from the protected lumber surface.

DETAILED DESCRIPTION OF THE INVENTION

Figure 1:
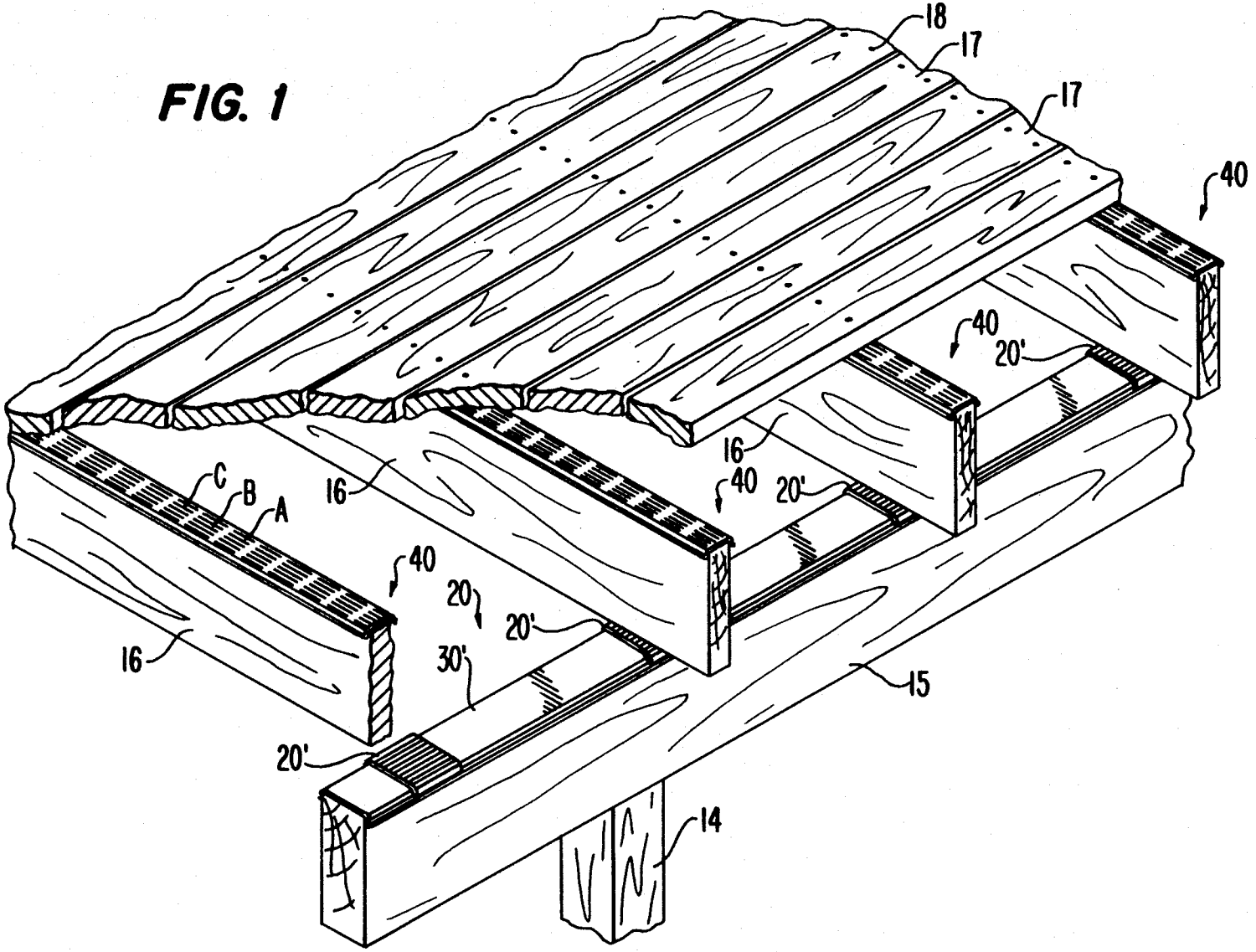
FIG. 1 is a perspective view showing a covering strip of the present invention used in conjunction with the construction of a wooden deck. The floor boards of the deck are partially cut-away for convenience of illustration.

Referring to FIG. 1, a protective covering strip in accordance with the present invention is shown in conjunction with the construction of a wooden deck. A first covering strip 20 is fitted over the top surface of a girder 15, which is itself mounted onto a vertical post 14. A plurality of joists 16 are positioned transversely along the length of girder 15 at spaced intervals, and a second covering strip 40 is fitted over the top surface of each of joists 16. Each of the covering strips may have an upper surface which gradually slopes downwardly from the horizontal on opposite sides of its centerline to prevent any excessive water collection. Covering strips 20 and 40 also are preferably constructed of a flexible waterproof material, such as rubber or a plastic compound, by extrusion.

In the preferred embodiment, the strips are dimensioned so that the length of each strip substantially corresponds to the length of the girder 15 or joist 16, respectively. Preferably, the strips are also dimensioned so that the distance between side portions, and hence the width of the channel formed adjacent the undersurfaces of the strips between the side portions, substantially corresponds to the width of the girder 15 or joist 16 so that a form-fitting relationship is obtained.

Figure 2:
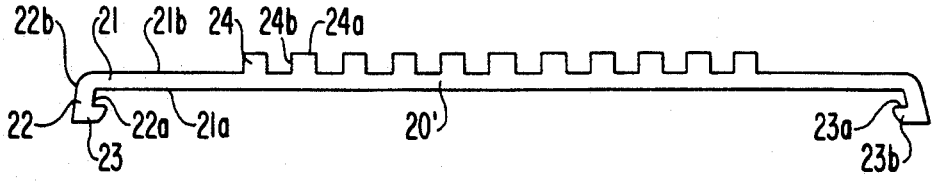
FIG. 2 is an end view of a cover member of the first embodiment of the invention.
Figure 5:
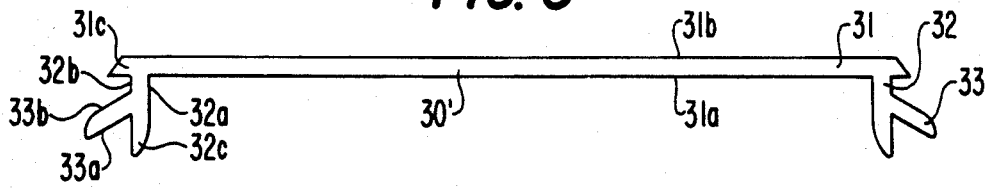
FIG. 5 is an end view of a base member of the first embodiment of the invention.
Figure 6:
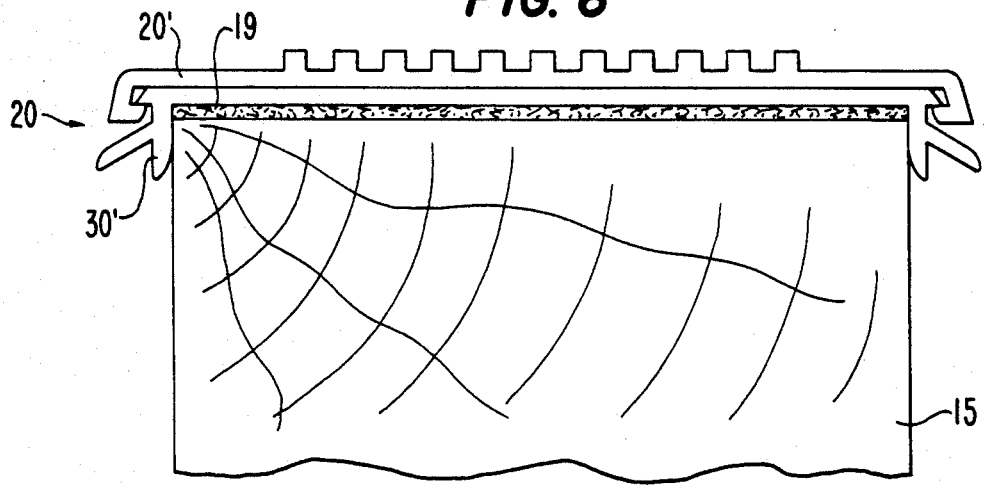
FIG. 6 is an end view of the base member and the cover member connected together with a fungicidal member and disposed on a girder.
Figure 11:
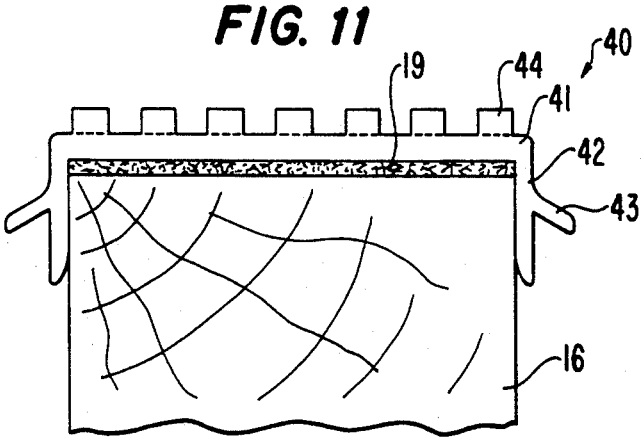
FIG. 11 is an end view of the covering strip as shown in FIG. 8 with a fungicidal member and disposed on a joist.
Figure 7:
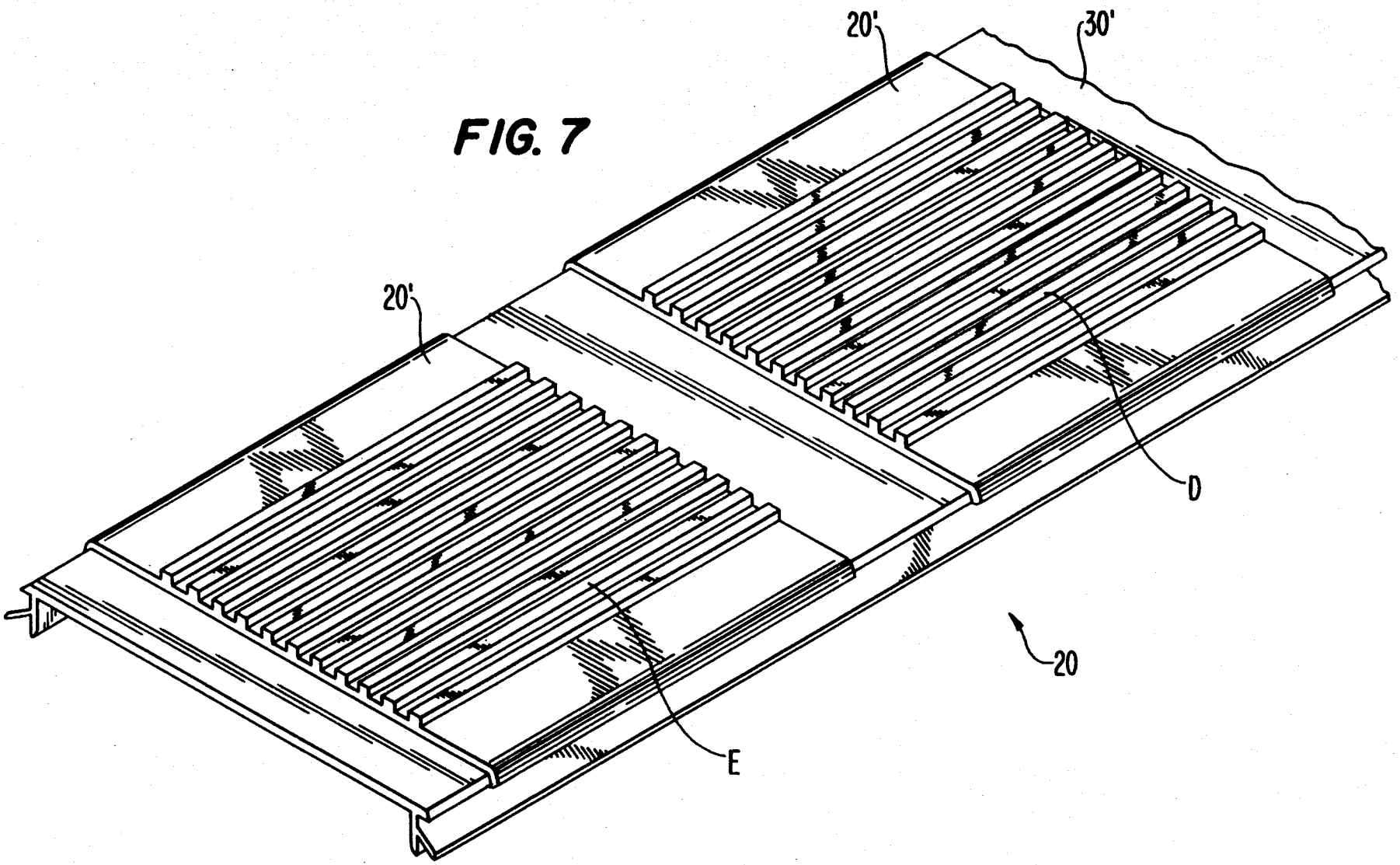
FIG. 7 is a perspective view of the base member having two cover members connected or snapped thereto.
Figure 8:
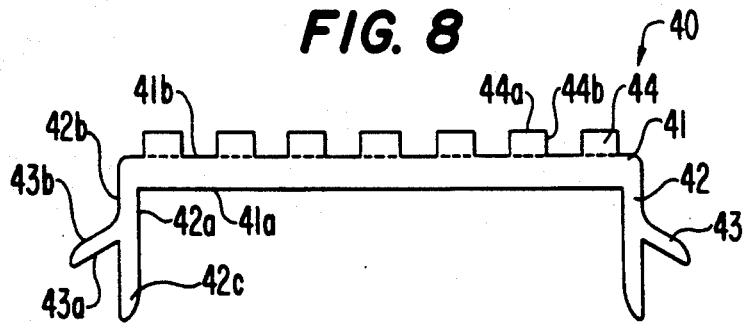
FIG. 8 is an end view of a second embodiment of the covering strip.

FIGS. 2–7 illustrate first covering strip 20. Covering strip 20 is a two-part construction as shown in FIGS. 6 and 7, and includes a base member 30' and at least one cover member 20'. As best shown in FIG. 2, cover member 20' includes a main body portion 21 and two side portions 22 integrally coupled on opposite sides of the main body portion. Each side portion 22 terminates at an inwardly directed flange 23 having a tapered tip 23*b* and a top surface 23*a*. Main body portion 21 also includes a bottom surface 21*a* and a top surface 21*b* having a plurality of protrusions 24 projecting upwardly therefrom. Protrusions 24 have a top surface 24*a* and side surfaces 24*b*. Preferably, protrusions 24 comprise a plurality of parallel ribs separated by intervening grooves defined by side surfaces 24*b*, and are disposed along the length of the covering strip.

As best shown in FIG. 5, base member 30' includes a main body portion 31 and two side portions 32 integrally coupled on opposite sides of the main body portion. Main body portion 31 includes a bottom surface 31*a* and a top surface 31*b*, and each side portion 32 includes an outer surface 32*b* and an inner surface 32*a*. Side portions 32 cooperate to define an inverted channel adjacent bottom surface 31*a* which extends longitudinally along the length of base member 30' between the side portions.

Each of side portions 32 has a fixed end coupled to main body portion 31 and a free end 32*c* opposite the fixed end. Free end 32*c* is tapered to facilitate placing the base member onto a wooden member. An angled side rail 33 projects outwardly from and runs substantially the entire length of each side portion 32. Disposed along either side of main body portion 31 proximate a side portion 32 is a lateral flange 31*c* which runs the entire length of base member 30'.

FIG. 6 illustrates covering strip 20 in use. Preferably a material layer or fungicidal strip 19 is fixedly secured to the bottom surface of base member 30' and extends along the entire length of the base member. Base member 30' is then placed on a wooden member 15 with the fungicidal strip in contact with the top surface of the wooden member. The fungicidal strip is preferably felt, but may be a fibrous material or any other material which retains the fungicide. The material should also be somewhat compressible to compensate for a wooden member having an uneven surface. The compressible nature of the material compensates for water or air pockets along the uneven surface. In situations where it is undesirable to dispose a fungicidal strip between the covering strip and the wooden member, the surface of the wooden member may be painted or coated with a fungicide before the covering strip is applied.

As shown in FIGS. 1 and 7, a plurality of cover members 20' are coupled to base member 30', and are spaced substantially longitudinally apart. In FIG. 7, a first cover member having a first group D of protrusions is substantially longitudinally spaced apart from a second cover member having a second group E of protrusions. Similarly, FIG. 1 illustrates a plurality of protrusions disposed on second covering strip 40. A first group A of protrusions is substantially longitudinally spaced apart from a second group B of protrusions and a third group C of protrusions.

Preferably, cover member 20' and base member 30' are configured to provide a snap fit connection so that cover member 20' is detachably attached to and slidably engages base member 30'. As best shown in FIG. 6, when coupled together, bottom surface 21*a* of cover member 20' substantially contacts top surface 31*b* of base member 30' and the bottom surface of lateral flange 31*c* contacts the upper surface 23*a* of inwardly directed flange 23. In use, protrusions 24 provide spacing between the overlying wooden members, and the intervening grooves disposed between the protrusions provide for air circulation and water drainage. The longitudinal spacing between cover members 20' (FIG. 7) also enhances water drainage from the joint between the wooden members.

FIGS. 8–11 illustrate second covering strip 40 which includes a main body portion 41 and two side portions 42. Side portions 42 are integrally coupled on opposite sides of the main body portion, and cooperate to define an inverted channel, adjacent the bottom surface 41*a* of main body portion 41, which extends longitudinally along the length of the strip between the side portions. A plurality of protrusions 44 are located along a top surface 41*b* of main body portion 41 in a laterally spaced-apart relationship and project above the surface of the strip to provide a base upon which the floor boards are set and nailed.

Figure 9:
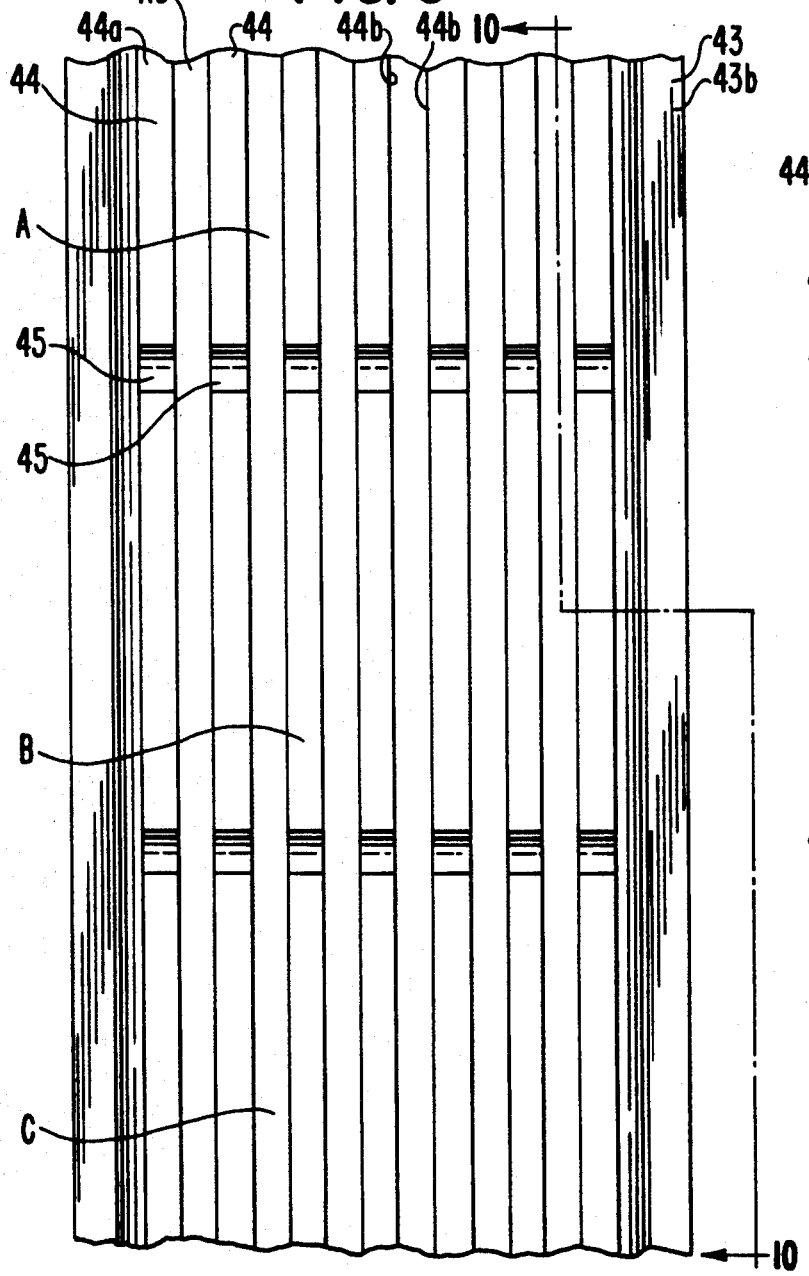
FIG. 9 is a top plan view of the covering strip as shown in FIG. 8.
Figure 10:
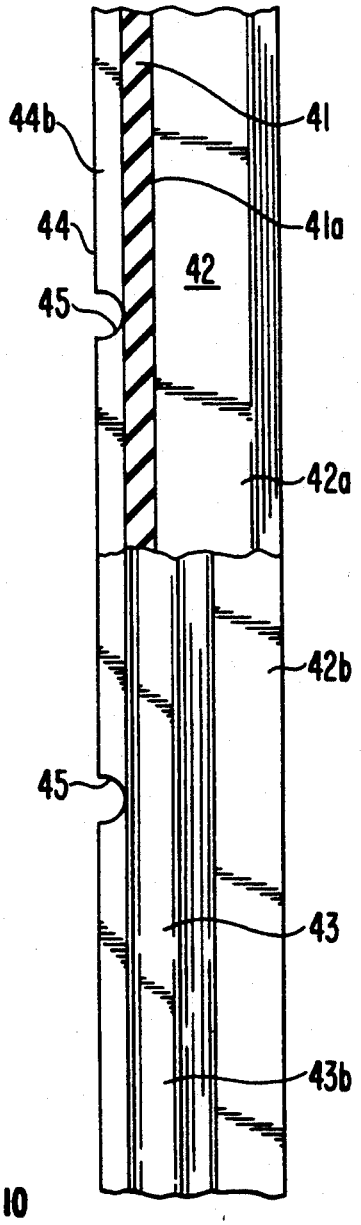
FIG. 10 is a side elevational view in partial cross-section of the covering strip taken along line 10—10 in FIG. 9.

As best shown in FIG. 9, protrusions 44 preferably comprise a plurality of parallel ribs separated by intervening grooves defined by side surfaces 44*b*, and are disposed along the length of the strip at preselected intervals to allow water to drain from the joint between the wooden members into the grooves and to provide air circulation at the joint. Lateral scoring 45, which may be accomplished in any conventional manner, i.e., by a milling operation, allows water in the intervening grooves to drain out and air to flow in. In FIG. 9, ribs 44 are substantially rectangular in shape, however, other lengthwise rib patterns could also be used, including square or semi-circular patterns.

The bottom surface 41*a* of main body portion 41 is substantially flat and preferably includes an elongated strip of felt 19 (see FIG. 11) saturated with a fungicide. The fungicidal strip is secured to the bottom surface 41*a* and extends along the entire length of the channel. In the preferred embodiment, the felt is saturated with a 46% copper napthenate which acts as a fungicide to prevent the growth of destructive fungus on the surface of the wooden joists. Although a felt strip is preferable, any fibrous material or any other material which retains the fungicide may be used. The material should be somewhat compressible to compensate for a wooden member having an uneven surface. It is also contemplated, for example, when using untreated lumber, to apply a coating of the fungicide along the surface of the wooden member which receives the covering strip.

Figure 12:
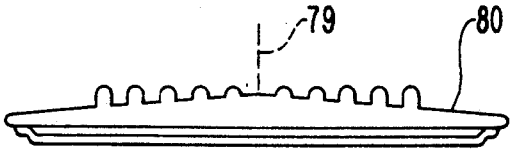
FIG. 12 is a partial end view of a covering strip of another embodiment of the invention.
Figure 4:
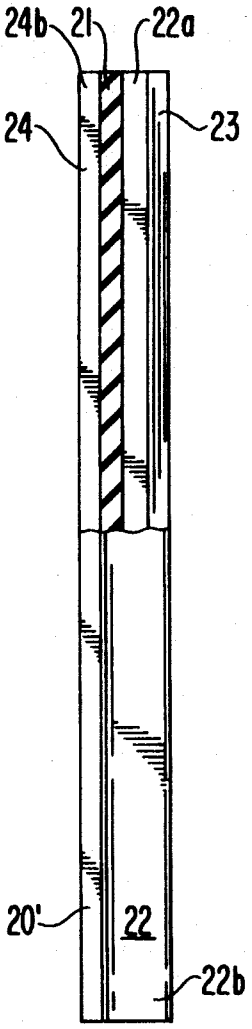
FIG. 4 is a side elevational view in partial cross-section of the cover member taken along line 4—4 in FIG. 3.
Figure 3:
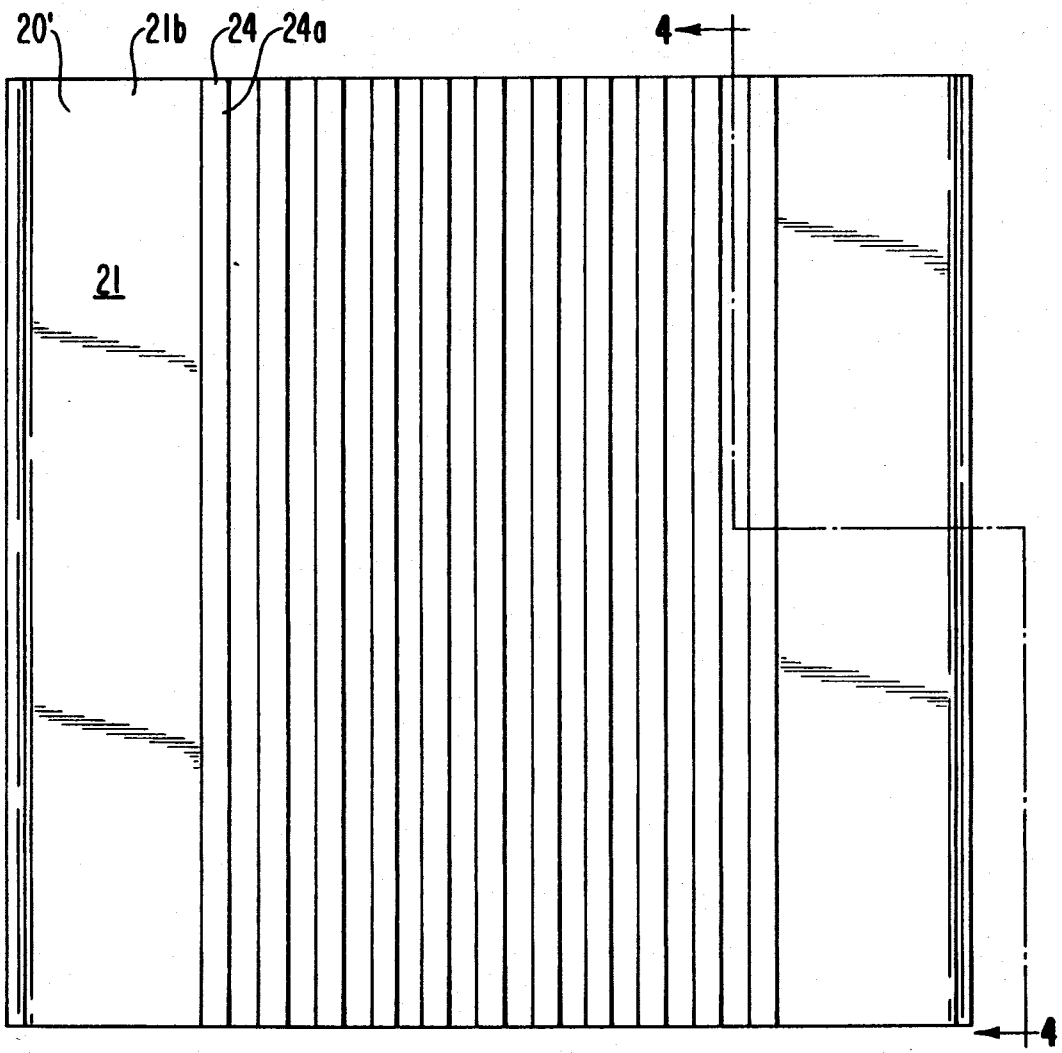
FIG. 3 is a top plan view of the cover member as shown in FIG. 2.

Referring again to FIG. 8, side portions 42 are undercut at right angles on their inner surfaces to fit the expected widths of the joists, and include side rails 43 disposed along their outer surfaces 42*b*. Top surface 41*b* of strip 40 preferably is substantially horizontal. But top surface 41*b* alternatively may be configured so that it gently slopes downwardly from the horizontal on opposite sides of its centerline as shown in FIG. 12. FIG. 12 illustrates a covering strip having a taper 80, and configured to gently slope downwardly from the horizontal on opposite sides of its center line 79.

As best seen in FIG. 1, protrusions 24, 44 function as a spacing mechanism between a first wooden member to be joined to a second wooden member overlying the first wooden member. The spacing mechanism must be sufficiently incompressible or hard to space the first and second wooden members apart, thereby permitting circulation of air at the joint between the first and second wooden members. The wooden members may be joined in any conventional manner, but are preferably joined by nailing the members together. For this reason, the spacing mechanism, in addition to being sufficiently hard to space the wooden members apart, must also be sufficiently elastic to form a water-tight seal around the fastening mechanism. Preferably, a high quality thermal plastic elastomer such as ELASTOLENE is used. Any material, such as a rubber or plastic compound having a durometer rating of 40 or higher on the scale for plastic compounds, which is necessary so the raised ribs on the strips will not be crushed by the weight of the joists and decking laid above them, is sufficient. If the covering strips are formed of a material other than plastic, then a higher or lower durometer rating may be necessary. The durometer rating of the material selected should be equivalent to a durometer rating of 40 on the scale for a plastic material.

It is contemplated to place the protrusions of the strips wherever any joining will be accomplished. Accordingly, wherever there is a plurality of wooden members in a closely aligned arrangement to be joined along a relatively short wooden member and its corresponding short covering strip as shown in FIG. 1, unitary strip 40 which has a plurality of groups of longitudinally spaced protrusions may be used. Along a relatively long wooden member, such as girders 15, and its corresponding long covering strip, it is not economical to mill a plurality of lateral grooves in the covering strip. For this reason, covering strip 20 is preferably used on girders 15 so that cover members 20' are placed only where joists 16 are required. Although it is preferred to use covering strips 40 on joists 16 and covering strips 20 on girders 15, the invention is not limited in this respect. One could use covering strips 40 on girders or covering strips 20 on joists.

Figure 13:
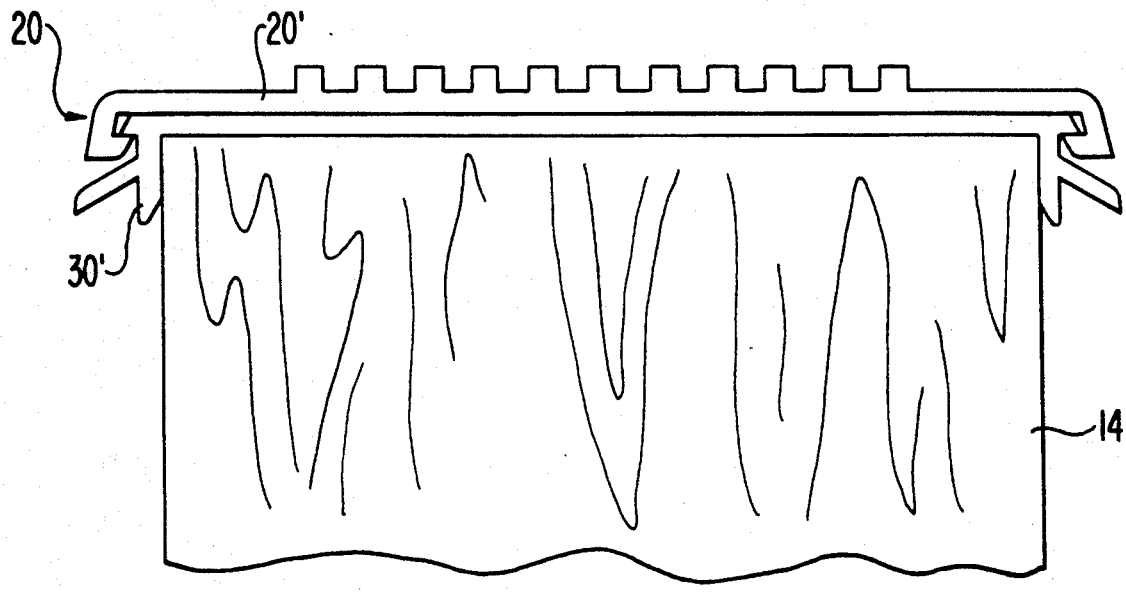
FIG. 13 is a partial side view of the covering strip of FIGS. 2 and 5 disposed on a post.

In use, in the construction, for example, of an open weather deck, strips 20, 40 are placed on the top surface of each of girders 15 or joists 16, respectively. A covering strip may also be placed as a cap on each post 14 as shown in FIG. 13. Covering strip 20 having a cover member 20' and a base member 30' of substantially identical length is used on post 14. A fungicidal strip of felt or other material may be placed between the covering strip and post to minimize the possibility of woodrot. If the use of a strip of material is undesirable, a coating of the fungicide may be directly applied to the top surface of the wooden member. Each girder having a covering strip disposed thereon is secured to the posts as desired. Joists 16 are then secured i.e., by nailing, to girders 15 at spaced intervals as desired. Wooden flooring or decking members 17 are then positioned over joists 16 and are nailed through strips 40 to complete the structural assembly.

In this arrangement, strips 20, 40 provide a waterproof seal around the nails used to secure the various members which prevents water collection in the nail holes, and the strips also separate the wooden members to prevent any direct contact between posts 14 and girders 15, between joists 16 and girders 15 and between joists 16 and floor boards 17. Joists 16 are, thus, protected from any direct contact with a wet surface, such as the exposed wooden deck. In addition, because protrusions 44, 24 are raised above the strip surface, air is allowed to freely circulate and water is permitted to drain at the joist/deck, joist/girder and the girder/post interfaces. Lateral scoring 45 in covering strip 40 and the lateral spacing between cover members 20' facilitate air circulation and water drainage about the joints between wooden members. This all reduces the likelihood of excessive moisture at the various joints, and, thus, also reduces the likely occurrence of structural degradation caused by fungal growth or woodrot. The side rails 43, 23 of strips 40, 20 serve to direct any water run-off away from the sides of the joists, girders and posts. This again protects the joints from water and moisture, and further reduces the likelihood of destructive woodrot. The likely occurrence of woodrot is also further diminished by use of felt member 19 secured to the bottom surfaces 41*a*, 21*a* of strips 40, 50, respectively, which is saturated with a fungicide.

Figure 15:
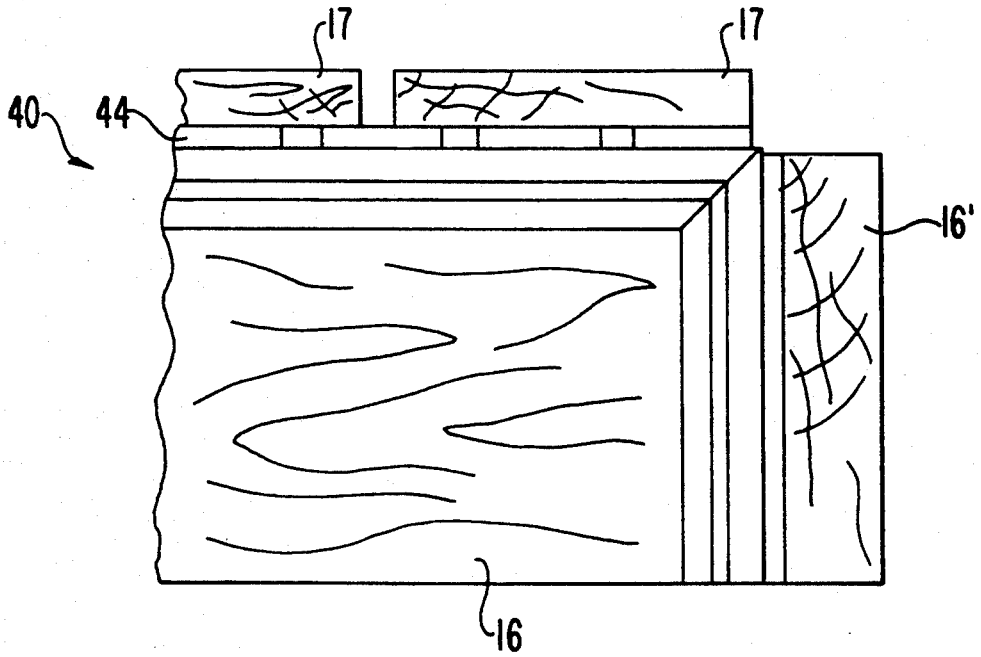
FIG. 15 is a side view of the wooden deck of FIG. 14 taken along line 15—15 in FIG. 14.
Figure 14:
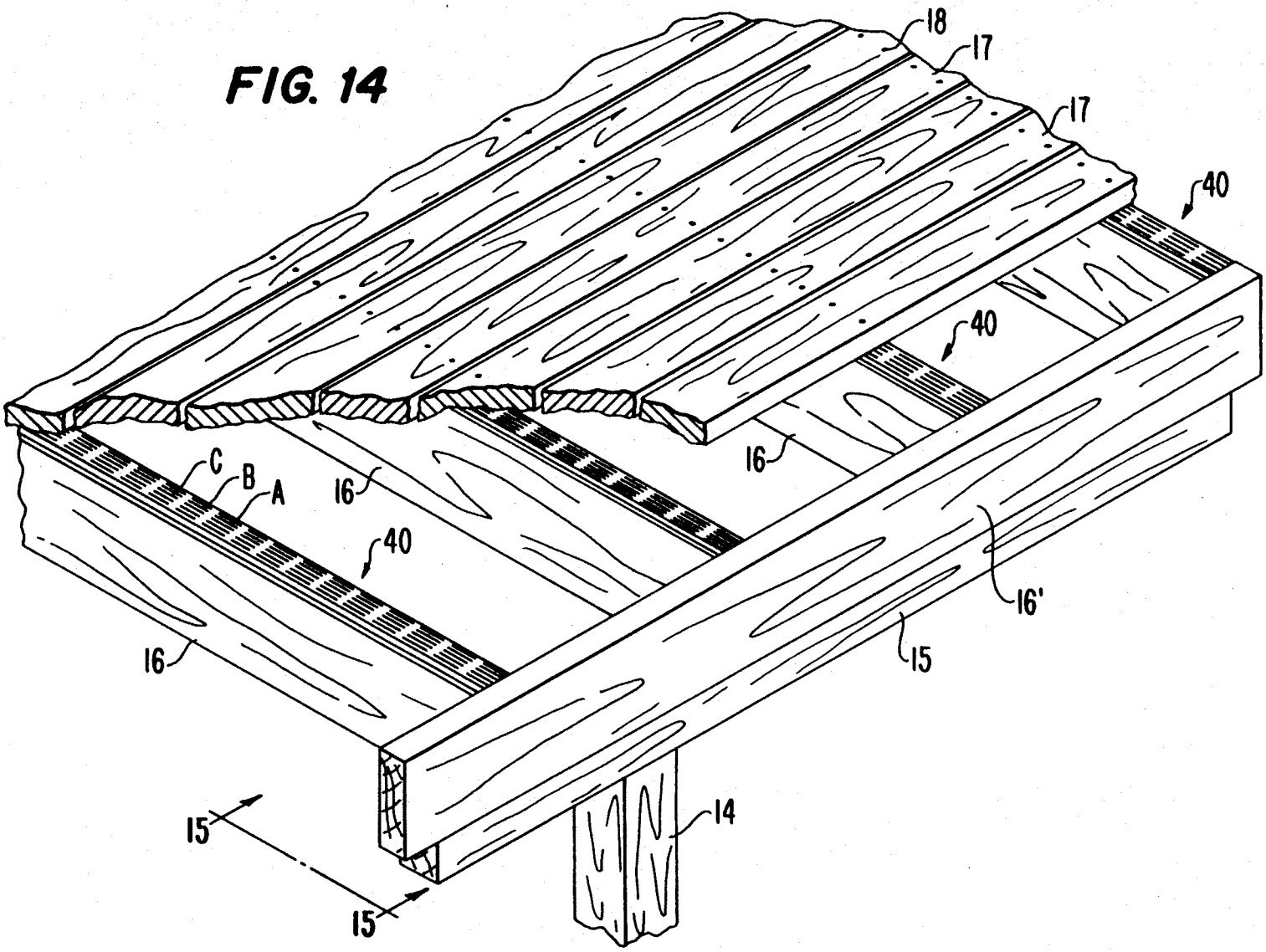
FIG. 14 is a perspective view showing a covering strip of the present invention in conjunction with the construction of a wooden deck having a rim joist.

To add structural stability to the wooden deck, a rim joist 16' may be secured to each joist 16 as shown in FIG. 14. The joint between joist 16 and rim joist 16' is very likely to collect excess moisture and promote the growth of woodrot. To minimize the likelihood of woodrot, the present invention provides a rim or extension of the covering strip about the side surfaces of the joint of the wooden members as shown in FIG. 15. Preferably each covering strip 40 is slightly longer at each end than the joist it is secured to. A 90° notch is formed in, preferably cut out of, each of the side rails 43 and side portions 42. At the end of each joist the protrusions 44 are cut through; the cut should be no deeper than to the top surface 41*b*. Covering strip 40 is then nailed to the joist about ¾" from the end of the joist. The overhanging portion of the strip is then bent downwardly at the location of the cut and notches, over the end grain of the joist and fastened thereto, preferably by nailing. For added protection a high grade butyl caulk is applied along the 45° degree angled joints that result from the 90° notches.

Though the invention has been described in detail in connection with the preferred embodiment, it will be easily understood by those skilled in the art that other variations and modifications can be made within the scope of this invention as defined by the following claims.

I claim:

1. A protective strip for covering a top surface of a first wooden member to be joined to a second wooden member overlying the first wooden member, said strip comprising:

an elongated body of water-impervious material sized to substantially cover the entire upper surface of the first wooden member, said body having a bottom surface contacting the first wooden member and a top surface opposite the bottom surface; and spacing means positioned on said body and projecting from said body to support said second wooden member above the top surface of the strip and for spacing the first and second wooden members apart, thereby permitting air circulation at the joint between the first and the second wooden members;

wherein said strip includes two side portions coupled to said body on opposite sides thereof for overlying the side edges of said first wooden member; and wherein each of said side portions includes a fixed end coupled to said body and a free end disposed opposite to said fixed end, said free end including a tapered portion to facilitate placement of said strip on the first wooden member.

2. The protective strip according to claim 1, wherein said strip further comprises a material layer associated with said body, said material layer including a fungicide.

3. The protective strip according to claim 2, wherein said material layer comprises felt saturated with a fungicide.

4. The protective strip according to claim 1, wherein said spacing means comprises a plurality of protrusions disposed in substantially longitudinally spaced-apart relationship along the top surface of said body.

5. The protective strip according to claim 4, wherein a portion of said plurality of said protrusions form a first group, another portion of said plurality of said protrusions form a second group and said first group is spaced substantially longitudinally from said second group.

6. The protective strip according to claim 1, wherein each of said side portions includes a beveled outer surface sloping outwardly and downwardly from the horizontal to direct water runoff away from the sides of said first wooden member.

7. The protective strip according to claim 1, wherein each of said side portions includes an angled side rail projecting outwardly therefrom.

8. The protective strip according to claim 1 wherein said strip is formed of a plastic compound.

9. The protective strip according to claim 1 wherein said strip includes a material layer fixedly secured to the bottom surface of said body and extending along the entire length of said body, said material layer includes a fungicide.

10. A protective strip for covering a top surface of a first wooden member to be joined to a second wooden member overlying the first wooden member, said strip comprising:

a base member disposed along a portion of the top surface of the first wooden member, said base member including a lateral flange extending outwardly from the first wooden member; and at least one cover member detachably securable to said base member, said cover member including an inwardly directed flange for engaging said lateral flange of said base member and thereby securing said cover member thereto and spacing means for spacing the first and the second wooden members apart, thereby permitting air circulation at the joint between the first and the second wooden members.

11. The protective strip according to claim 10, wherein said protective strip further comprises:

a material layer associated with said base member, said material layer including a fungicide.

12. The protective strip according to claim 10, wherein said spacing means includes at least one protrusion projecting upwardly from the surface of said at least one cover member.

13. The protective strip according to claim 12, wherein said at least one protrusion extends continuously across a portion of a top surface of said at least one cover member.

14. The protective strip according to claim 12, wherein said protective strip includes a plurality of cover members, each of said cover members is detachably attached to said base member and substantially longitudinally spaced apart from an adjacent cover member.

15. The protective strip according to claim 12, wherein said base member includes an elongated body having two side portions depending therefrom on opposite sides thereof.

16. The protective strip according to claim 15, wherein each of said side portions includes an angled side rail projecting outwardly therefrom.

17. A covering strip for covering a first surface of a first wooden member to be joined to a second wooden member, said strip comprising:

an elongated body of water-impervious material sized to substantially cover the first surface of the first wooden member;

spacing means positioned on said body and projecting outwardly from said body for maintaining an air space and facilitating air circulation between the first and second wooden members, said spacing means including a plurality of longitudinally disposed ribs; and circulating means associated with said body for permitting fluid circulation at the joint between the first and second wooden members said circulating means including a plurality of intervening grooves, each of said intervening grooves being defined by the space between two adjacent longitudinally disposed ribs.

18. The covering strip according to claim 17 wherein said plurality of longitudinally disposed ribs include lateral scoring interspersed along the length of said ribs such that water in said intervening grooves can drain out and air can flow thereto.

* * * * *